US007168638B2

(12) United States Patent
Saito et al.

(10) Patent No.: US 7,168,638 B2
(45) Date of Patent: Jan. 30, 2007

(54) FUEL INJECTION VALVE

(75) Inventors: Takahiro Saito, Gunma (JP); Hidehiko Koyashiki, Gunma (JP)

(73) Assignee: Hitachi Unisia Automotive, Ltd., Kanagawa (JP)

( * ) Notice: Subject to any disclaimer, the term of this patent is extended or adjusted under 35 U.S.C. 154(b) by 209 days.

(21) Appl. No.: 10/798,343

(22) Filed: Mar. 12, 2004

(65) Prior Publication Data

US 2004/0188552 A1 Sep. 30, 2004

(30) Foreign Application Priority Data

Mar. 25, 2003 (JP) ..... 2003-082778

(51) Int. Cl.
*B05B 1/30* (2006.01)

(52) U.S. Cl. ..... 239/585.1; 239/533.2; 239/600; 239/900; 251/129.15

(58) Field of Classification Search ..... 239/585.1, 239/533.2, 900, 600; 251/129.15
See application file for complete search history.

(56) References Cited

U.S. PATENT DOCUMENTS 3,873,492 A * 3/1975 Takehisa et al. ..... 523/205
5,381,965 A * 1/1995 Chabon et al. ..... 239/585.1
5,465,911 A * 11/1995 Hall ..... 239/585.4
5,823,445 A * 10/1998 Sofer ..... 239/585.1
6,382,532 B1 * 5/2002 French et al. ..... 239/585.1
2001/0045473 A1 11/2001 Landschoot et al.
2002/0168896 A1 11/2002 Suzuki

FOREIGN PATENT DOCUMENTS

CN 1118792 A 3/1996
DE 197 39 150 A1 3/1999
JP 2002-534638 A 10/2002

* cited by examiner

*Primary Examiner*—Dinh Q. Nguyen
(74) *Attorney, Agent, or Firm*—Sughrue Mion, PLLC

(57) ABSTRACT

A fuel injection valve includes a soundproofing cover molded out of a rubber-containing soft resin and arranged on the outer periphery of a metal casing. Collision noises and vibrations are absorbed by the soundproofing cover, achieving excellent sound insulation. Moreover, the rubber-containing soft resin is lower in cost, and can be shaped by injection molding, resulting in a reduction in manufacturing cost of the valve.

5 Claims, 3 Drawing Sheets

FUEL INJECTION VALVE

BACKGROUND OF THE INVENTION

The present invention relates generally to a fuel injection valve of an internal combustion engine and the like, and more particularly, to a technique for intercepting collision noises and vibrations during opening and closing of a valve element.

As disclosed in JP-A 2002-534638 (=WO0040855), a fuel injection valve of an internal combustion engine and the like is typically constructed such that a valve element seated on a valve seat by biasing force of a return spring is lifted and opened by an electromagnetic actuator.

This fuel injection valve produces collision noises during opening and closing of the valve element, and more specifically, collision noise at a valve seat during valve closing and that one at a stopper of the valve element or its conjunction during valve opening. Such collision noises and vibrations resulting therefrom are propagated through component members, and emitted from a hard-resin envelope molded over a casing, forming a noise source.

In order to intercept noises and vibrations, the fuel injection valve is typically covered with a soundproofing material such as foam rubber, foam resin, or the like. However, this solution needs not only a soundproofing material which is expensive per se, but also a process of mounting the separate and distinct soundproofing material on the fuel injection valve, resulting in further increase in manufacturing cost of the valve.

SUMMARY OF THE INVENTION

It is, therefore, an object of the present invention to provide a fuel injection valve which allows a reduction in harmful sound emission during opening and closing of the valve element with lower manufacturing cost.

The present invention provides generally a fuel injection valve, comprising: a casing; a valve element axially slidably arranged through the casing; a valve seat on which the valve element is seated; and a cover arranged on an outer periphery of the casing, the cover being molded out of a soft resin containing a rubber.

A main feature of the present invention lies in providing a method of manufacturing a fuel injection valve, the fuel injection valve comprising a casing, a valve element axially slidably arranged through the casing, and a valve seat on which the valve element is seated, the method comprising: molding a cover out of a soft resin containing a rubber, the cover being arranged on an outer periphery of the casing.

BRIEF DESCRIPTION OF THE DRAWINGS

The other objects and features of the present invention will become apparent from the following descriptions with reference to the accompanying drawings, wherein.

DETAILED DESCRIPTION OF THE INVENTION

Figure 1A:
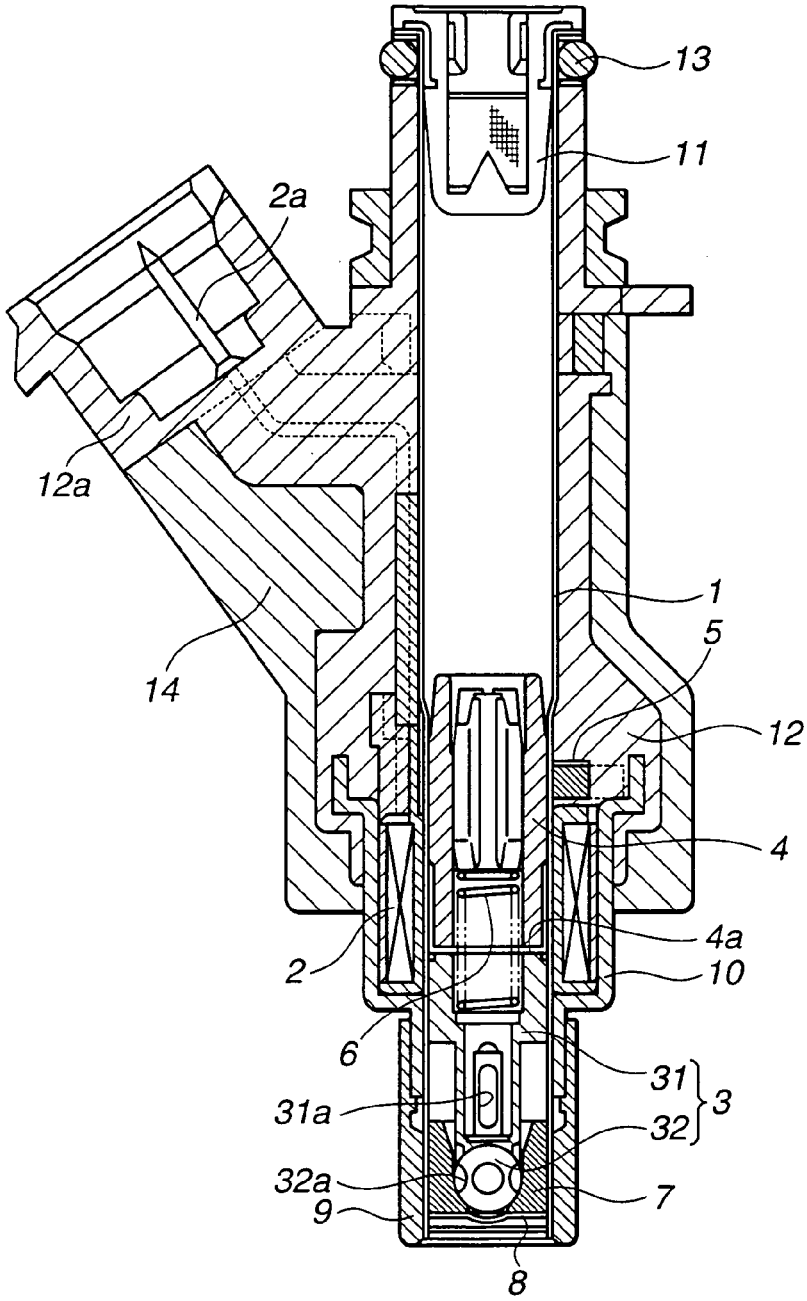
FIG. 1A is a sectional view showing a first embodiment of a fuel injection valve according to the present invention.

Referring to the drawings, a description is made about a fuel injection valve of an internal combustion engine embodying the present invention.

Figure 1B:
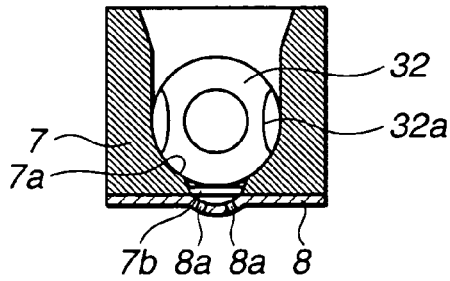
FIG. 1B is an enlarged fragmentary sectional view showing a valve-seat member.
Figure 2:
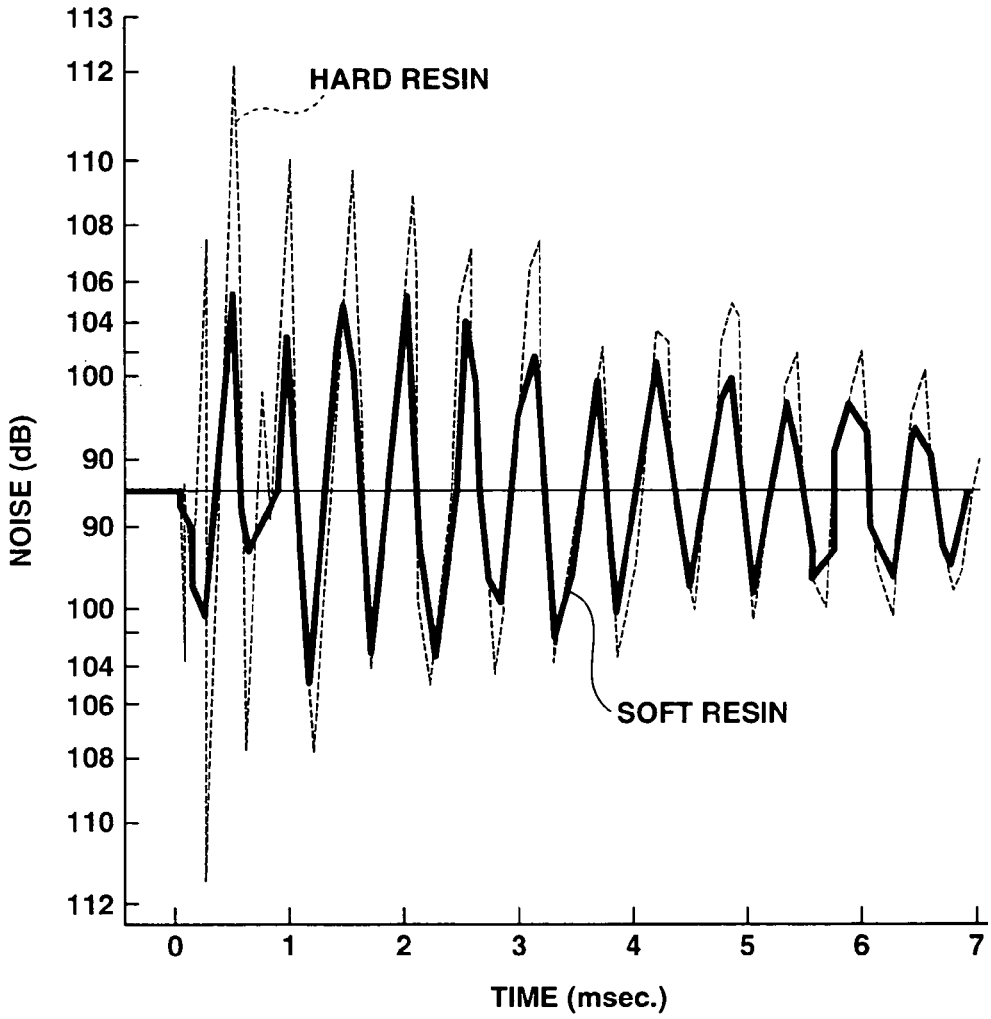
FIG. 2 is a graph illustrating a sound-insulation effect of a soft resin used in the first embodiment.

Referring to FIGS. 1A–2, there is shown first embodiment of the present invention. Referring to FIGS. 1A and 1B, the fuel injection valve comprises a tubular casing 1 made of a magnetic material such as metal, an electromagnetic coil or actuator 2 fixedly mounted on the outer periphery of casing 1, and a valve element 3 axially slidably arranged through casing 1 and including a tubular anchor 31 and a ball 32 integrated together by welding. A fuel opening 31*a* is formed in the lower peripheral wall of anchor 31. Ball 32 has on the periphery a plurality of flat surfaces 32 obtained by machining.

A tubular spring housing 4 is fixedly mounted on the inner wall of casing 1 above valve element 3 (anchor 31) as viewed in FIG. 1A with a predetermined clearance defined therebetween. A tubular spring stopper 5 is fixedly arranged through spring housing 4, and a return spring 6 is arranged between a lower end of spring stopper 5 and a stepped portion of anchor 31 in a compressed state. During non-energization of electromagnetic coil 2, the fuel injection valve is closed with valve element 3 seated on a seating face 7*a* of a valve-seat member 7 as will be described later by a resilient compressive force of return spring 6.

As best seen in FIG. 1B, valve-seat member 7 comprises seating face 7*a* for seating ball 32 of valve element 3 and an injection opening 7*b* formed in the center. Valve-seat member 7 is welded on the inner periphery of the lower end of casing 1. A nozzle plate 8 having a plurality of nozzle openings 8*a* is welded at the lower end of valve-seat member 7.

A cap member 9 is fixedly engaged on the outer periphery of the lower end of casing 1, and a coil cover 10 for covering the outer periphery of electromagnetic coil 2 has a lower end welded to casing 1.

A fuel filter 11 is fixedly engaged in the upper end of casing 1.

A hard-resin envelope 12 is obtained by injection molding of a hard resin which is subjected to a portion extending from the upper end of coil cover 10 to that of casing 1 and a portion corresponding to electromagnetic coil 2 except an end of a lead 2*a*. A seal member 13 is arranged between the upper end face of envelope 12 and the upper-end flange face of casing 1.

Envelope 12 is formed with a connector 12*a* obtained by surrounding the end of lead 2*a* of electromagnetic coil 2.

In the first embodiment, the fuel injection valve has an outer periphery covered, except the upper end of envelope 12 and connector 12*a*, with a soundproofing cover 14 molded out of a rubber-containing soft resin wherein the ratio between the rubber and the soft resin is 50:50, for example.

In the fuel injection valve constructed in such a way, fuel fed by a fuel pump, not shown, is introduced from fuel filter 11 into casing 1 through a fuel line, which comes to the inside of spring stopper 5 and anchor 31. Then, fuel flows out to an outside space from fuel opening 31*a* to be charged from a clearance between a peripheral flat surface 32*a* of ball 32 and seating face 7*a* to a closed portion obtained by contact between ball 32 and seating face 7*a*.

When energizing electromagnetic coil 2, valve element 3 made of a magnetic material is moved upward by an electromagnetic force against a biasing force of return spring 6, stroking up to a position where the upper end face of anchor 31 collides with a lower end face 4*a* of spring housing 4.

With this, ball 32 of valve element 3 is separated from seating face 7*a* to put the fuel injection valve in the open state. Thus, referring to FIG. 1B, fuel is radially injected from injection opening 7*b* formed in the center of seating face 7*a* of valve-seat member 7 and nozzle openings 8*a* formed in nozzle plate 8.

On the other hand, when interrupting energization of electromagnetic coil 2, valve element 3 is moved downward by a biasing force of return spring 6, colliding with seating face 7*a* of valve-seat member 7 for seating, putting the fuel injection valve in the closed state.

In such a way, during opening and closing of the fuel injection valve, when valve element 3 collides with lower end face 4*a* of spring housing 4 and seating face 7*a* of valve-seat member 7, collision noises and vibrations are produced and transmitted to metal casing 1 and hard-resin envelope 12. However, such collision noises and vibrations are absorbed by soft-resin soundproofing cover 14 which conceals most of hard-resin envelope 12, achieving excellent sound insulation.

Moreover, a rubber-containing soft resin is lower in cost than a pure rubber, and can be shaped by injection molding, resulting in restriction of manufacturing cost of the fuel injection valve.

There is no need to conceal a portion of the fuel injection valve below envelope 12, since it is arranged to face the intake passage, and thus has less outside leakage of noises produced thereat.

FIG. 2 shows results of measurement on the sound pressure or noise produced when dropping an iron ball on plates made of the soft resin which forms soundproofing cover 14 and the hard resin which forms envelope 12, respectively. The sound pressure is measured by a sensor arranged above the plates. It is seen from FIG. 2 that the soft resin allows a great reduction in the maximum sound-pressure level as compared with the hard resin.

Figure 3:
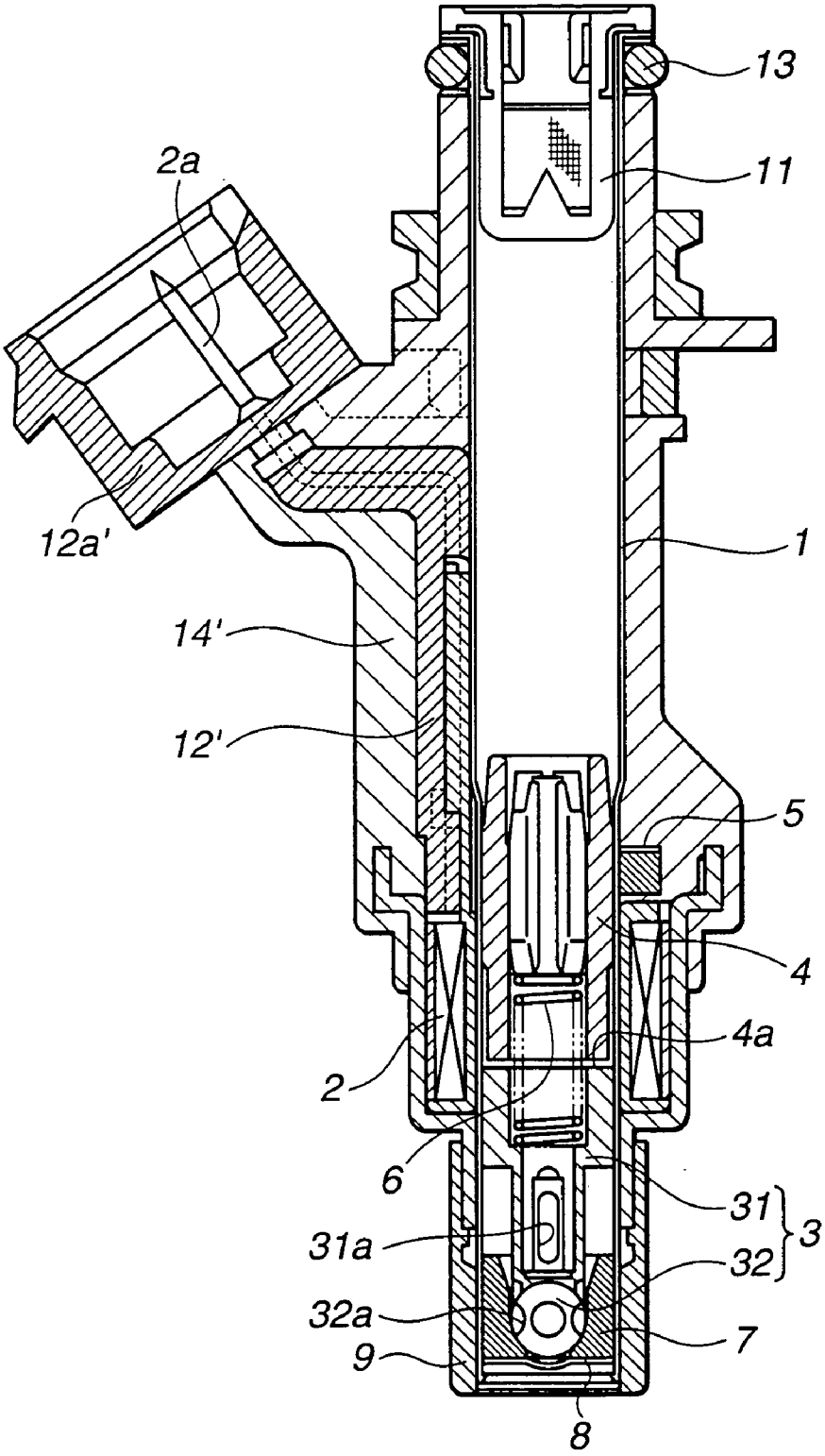
FIG. 3 is a view similar to FIG. 1, showing a second embodiment of the present invention.

Referring to FIG. 3, there is shown second embodiment of the present invention which is substantially the same as the first embodiment except the following:

Specifically, in the first embodiment, a portion of the fuel injection valve corresponding to electromagnetic coil 2 is formed such that a winding is provided around a bobbin of electromagnetic coil 2, then the outer periphery of electromagnetic coil 2 is molded out of a hard resin. In the second embodiment, at this process, the perimeter of a terminal connected to the winding and extending to a connector 12*a*' is integrally molded as an assembly, thus obtaining a hard-resin envelope 12'.

More specifically, in the first embodiment (in the related art as well), electromagnetic coil 2 having a winding with outer periphery molded out of a hard resin is arranged in coil cover 10, then hard-resin envelope 12 is molded on the outer periphery of electromagnetic coil 2. On the other hand, in the second embodiment, the hard-resin outer periphery of the winding and hard-resin envelope 12 are formed integrally, and hard-resin molding is provided to the outside of the winding and the perimeter of the terminal only, i.e. a minimum portion of electromagnetic coil 2 which requires the strength.

A soundproofing cover 14' is arranged on the outer periphery of hard-resin envelope 12' except a portion corresponding to connector 12*a*' and that of metal casing 1 above the upper portion of coil cover 10. Soundproofing cover 14' is molded out of a rubber-containing soft resin wherein the ratio between the rubber and the soft resin is 50:50, for example.

In the second embodiment, it is possible to not only secure a sound-insulation effect, but also mold the outer periphery of electromagnetic coil 2 and the terminal portion extending to connector 12*a*' at once, allowing reduction in the number of processes and thus further reduction in manufacturing cost of the fuel injection valve.

Having described the present invention in connection with the illustrative embodiments, it is noted that the present invention is not limited thereto, and various changes and modifications can be made without departing from the scope of the present invention.

By way of example, in the illustrative embodiments, a rubber-containing soft resin is such that the ratio between the rubber and the soft resin is 50:50. Optionally, the ratio may be roughly 20:80 to 80:20. Such ratio allows compatibility between excellent achievement of sound insulation by the function of a rubber and easiness of injection molding by the function of a resin.

As described above, according to the present invention, a rubber-containing soft resin is lower in cost than a pure rubber, and can be shaped by injection molding, resulting in a reduction in manufacturing cost of the fuel injection valve. This also leads to excellent achievement of sound insulation of the fuel injection valve with lower cost.

Further, since the outer periphery of the metal casing is molded out of a hard resin, and the cover is molded out of a rubber-containing soft resin to be arranged thereon, sound insulation of the fuel injection valve can be achieved while securing the strength thereof.

Furthermore, since the envelope is molded out of a hard resin to conceal the outer periphery of the coil and a portion extending to the connector, molding of this area can be made at once while securing a sound-insulation effect, allowing reduction in the number of processes and thus further reduction in manufacturing cost of the fuel injection valve.

The entire teachings of Japanese Patent Application P2003-082778 file Mar. 25, 2003 are hereby incorporated by reference.

What is claimed is:

1. A fuel injection valve, comprising:

a casing;

a valve element axially slidably arranged through the casing;

a valve seat on which the valve element is seated; and a cover arranged on an outer periphery of the casing and forming an outer layer, the cover being molded out of a soft resin containing a rubber, wherein the casing is made of a metal, the outer periphery of the casing being molded out of a hard resin and forming an inner layer.

2. The fuel injection valve as claimed in claim 1, further comprising:

an actuator which drives the valve element, the actuator comprising a coil and a connector; and an envelope which conceals an outer periphery of the coil and a portion extending to the connector, the envelope being molded out of a hard resin, wherein the envelope is concealed with the cover.

3. The fuel injection valve as claimed in claim 1, wherein the soft resin is constructed such that a ratio between the rubber and the soft resin is 50:50.

4. The fuel injection valve as claimed in claim 1, wherein the soft resin is constructed such that a ratio between the rubber and the soft resin is 20:80 to 80:20.

5. A fuel injection valve, comprising:

a casing;

a valve element axially slidably arranged through the casing;

a valve seat on which the valve element is seated;

a cover arranged on an outer periphery of the casing, the cover being molded out of a soft resin containing a rubber;

an actuator which drives the valve element, the actuator comprising a coil and a connector; and an envelope which conceals an outer periphery of the coil and a portion extending to the connector, the envelope being molded out of a hard resin, wherein the envelope is concealed with the cover.

* * * * *